US011183793B2

(12) United States Patent
Liptak et al.

(10) Patent No.: US 11,183,793 B2
(45) Date of Patent: Nov. 23, 2021

(54) CONNECTOR SYSTEM WITH A TERMINAL RETAINING DEVICE HAVING A REVERSE HINGED LOCK FEATURE

(71) Applicant: Aptiv Technologies Limited, St. Michael (BB)

(72) Inventors: Nicole L. Liptak, Cortland, OH (US); Christopher A. Margrave, Ashtabula, OH (US); Dominic A. Messuri, Canfield, OH (US); Michael D. Messuri, Canfield, OH (US)

(73) Assignee: APTIV TECHNOLOGIES LIMITED

( * ) Notice: Subject to any disclaimer, the term of this patent is extended or adjusted under 35 U.S.C. 154(b) by 127 days.

(21) Appl. No.: 16/566,047

(22) Filed: Sep. 10, 2019

(65) Prior Publication Data

US 2020/0112125 A1 Apr. 9, 2020

Related U.S. Application Data

(60) Provisional application No. 62/742,635, filed on Oct. 8, 2018.

(51) Int. Cl.
*H01R 13/514* (2006.01)
*H01R 13/627* (2006.01)
(Continued)

(52) U.S. Cl.
CPC ..... *H01R 13/6273* (2013.01); *H01R 13/422* (2013.01); *H01R 13/424* (2013.01);
(Continued)

(58) Field of Classification Search
CPC ..... H01R 13/422; H01R 13/62273; H01R 13/424; H01R 13/428
(Continued)

(56) References Cited

U.S. PATENT DOCUMENTS 6,102,726 A * 8/2000 Tsuji ..... H01R 13/6272 439/352
6,341,972 B1 * 1/2002 Odorfer ..... H01R 13/641 439/352
(Continued)

FOREIGN PATENT DOCUMENTS

CN 1223486 A 7/1999
CN 1697263 A 11/2005
JP H0869842 A 3/1996

OTHER PUBLICATIONS

Non Final Chinese Office Action for CN Application No. 201910916544.5, dated Oct. 12, 2020, 5 pages.

*Primary Examiner* — Abdullah A Riyami
*Assistant Examiner* — Thang H Nguyen
(74) *Attorney, Agent, or Firm* — Billion & Armitage

(57) ABSTRACT

A connector system includes a connector body defining a terminal cavity and a first and second groove each extending along an outer surface of the connector body and a terminal retainer attached to the connector body and moveable from a pre-staged position to a staged position. The terminal retainer retains a terminal within the cavity in the staged position. The terminal retainer has a base, a pair of first cantilevered arms extending from the base, a crossbar extending between the first arms defining a first latch feature, and a second cantilevered arm extending from the crossbar. The second arm is between the pair of first arms and defines a second latch feature. The first latch feature engages the first groove in the pre-staged position and the second groove in the staged position. The second latch feature engages the first groove in the staged position.

12 Claims, 6 Drawing Sheets

(51) Int. Cl.

| | |
|---|---|
| ***H01R 3/00*** | (2006.01) |
| ***H01R 13/424*** | (2006.01) |
| ***H01R 13/428*** | (2006.01) |
| ***H01R 13/422*** | (2006.01) |
| ***H01R 13/639*** | (2006.01) |
| ***H01R 13/436*** | (2006.01) |
| ***H01R 13/502*** | (2006.01) |

(52) U.S. Cl.
CPC ..... *H01R 13/428* (2013.01); *H01R 13/4361* (2013.01); *H01R 13/502* (2013.01); *H01R 13/639* (2013.01)

(58) Field of Classification Search
USPC ..... 439/752, 352, 489
See application file for complete search history.

(56) References Cited

U.S. PATENT DOCUMENTS 6,530,799 B2 3/2003 Regnier et al.
7,086,910 B2 * 8/2006 Tanaka ..... H01R 13/4362 439/752
7,108,539 B2 * 9/2006 Gunreben ..... H01R 13/639 439/352
7,238,039 B2 7/2007 Holweg
7,396,253 B2 * 7/2008 Nakamura ..... H01R 13/641 439/188
7,458,852 B2 * 12/2008 Gunreben ..... H01R 13/447 439/596
7,766,685 B2 8/2010 Pabst et al.
7,811,115 B1 * 10/2010 Tyler ..... H01R 13/53 439/352
8,210,864 B1 7/2012 Hernandez et al.
8,235,744 B1 8/2012 Liptak et al.
8,262,410 B2 9/2012 Campbell et al.
8,784,127 B2 7/2014 Bashkin et al.
8,882,521 B2 11/2014 Conway et al.
9,054,457 B2 6/2015 Odorfer et al.
9,071,016 B2 6/2015 Morello et al.
9,099,809 B2 8/2015 George et al.
9,153,899 B2 10/2015 Morello et al.
9,172,183 B2 10/2015 Siwek et al.
9,350,116 B1 5/2016 Morello et al.
9,407,026 B2 8/2016 Campbell et al.
9,409,536 B2 8/2016 Gunreben et al.
9,425,534 B2 * 8/2016 Schmidt ..... H01R 13/6272
9,455,523 B1 * 9/2016 Sundarakrishnamachari ..... H01R 13/62927
9,520,674 B2 12/2016 Regnier et al.
9,537,267 B2 1/2017 Odorfer et al.
9,590,348 B2 * 3/2017 Grudzewski ..... H01R 13/5202
9,711,898 B2 7/2017 Zabielski
9,787,031 B2 10/2017 Ludwig et al.
9,917,381 B1 3/2018 Campbell et al.
10,109,953 B2 * 10/2018 Schmidt ..... H01R 13/639
10,290,972 B2 5/2019 Gunreben et al.
10,290,976 B2 * 5/2019 Holweg ..... H01R 13/193
2007/0054535 A1 * 3/2007 Hall ..... H01R 13/6272 439/352
2018/0109035 A1 4/2018 Lehmann et al.

* cited by examiner

CONNECTOR SYSTEM WITH A TERMINAL RETAINING DEVICE HAVING A REVERSE HINGED LOCK FEATURE

CROSS-REFERENCE TO RELATED APPLICATION

This application claims the benefit under 35 U.S.C. § 119(e) of U.S. Provisional Patent Application No. 62/742,635 filed on Oct. 8, 2018, the entire disclosure of which is hereby incorporated by reference.

TECHNICAL FIELD OF THE INVENTION

The invention generally relates to a connector system configured to interconnect two or more conductors, such as electrical wire cables, particularly to a connector system with a terminal retaining device having a reverse hinged lock feature.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1B:
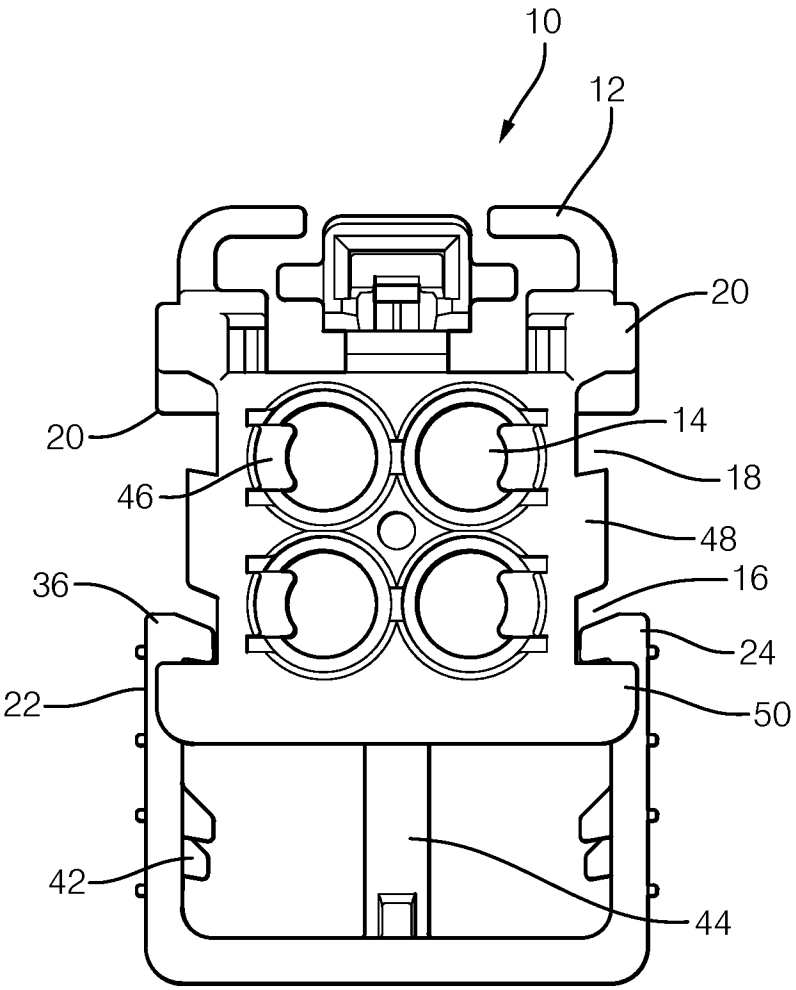
FIG. 1B is an end view of the connector of FIG. 1A with the terminal retainer device in the pre-staged position, according to one embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

FIGS. 1A through 2B illustrate an example of a connector system, hereinafter referred to as the connector 10. In this illustrated example the connector 10 is configured to interconnect wire cables having terminals (not shown) attached to ends of the cables (not shown). The connector 10 includes a connector body 12 that defines a number of terminal cavities, hereinafter referred to as cavities 14, extending longitudinally through the connector body 12. The cavities 14 are configured to receive and retain the terminals. The connector body 12 also defines a pair of first grooves, hereinafter referred to as the lower grooves 16 and a pair of second grooves, hereinafter referred to as the upper grooves 18 in two opposite outer surfaces 20 of the connector body 12. The connector body 12 is formed of a dielectric polymer material, such as polyamide (NYLON), polybutylene terephthalate (PBT), or acrylonitrile butadiene styrene (ABS).

The connector 10 also includes a terminal retaining device, hereinafter referred to as the retainer 22. The retainer 22 is also formed of a dielectric polymer material, such as NYLON, PBT, or ABS. The retainer 22 is attached to the connector body 12 and is moveable from a pre-staged position 24 shown in FIGS. 1A and 1B which allows the terminals to be inserted or removed from the cavities 14 to a staged position 26 shown in FIGS. 2A and 2B which inhibits terminals from being inserted or removed from the cavities 14. The retainer 22 has a generally planar base portion, hereinafter referred to as the base 28. Pairs of complaint first cantilevered arms, hereinafter referred to as the outer arms 30, have fixed ends 32 that are attached to and extend upwardly from two opposed distal edges of the base 28. A crossbar 34 extends between the free ends of each pair of the outer arms 30 as best shown in the isolated view of the retainer 22 in FIG. 3. The crossbars 34 each define first latch features 36 that are configured to engage the lower grooves 16 when the retainer 22 is in the pre-staged position 24 and the upper grooves 18 in the staged position 26. The retainer 22 also includes complaint second cantilevered arms, hereinafter referred to as inner arms 38, that have fixed ends 40 that are attached to the crossbars 34. The inner arms 38 are located between the pair of outer arms 30 and extend downwardly from the crossbar 34 in the opposite direction of the outer arms 30. The free ends of the inner arms 38 define second latch features 42 that are configured to engage the lower grooves 16 when the retainer 22 is in the staged position 26. The inner arms 38 may be described as "reverse hinged" since the fixed ends 40 of the inner arms 38 are opposite the fixed ends 32 of the outer arms 30.

The retainer 22 further includes a terminal retaining post, hereinafter referred to as the post 44, that extends perpendicularly upwardly from the base 28 through an opening (now shown) in the bottom surface of the connector body 12. The post 44 is configured to partially block the rear openings of the cavities 14, thereby inhibiting insertion or removal of the terminals from the cavities 14.

Figure 1A:
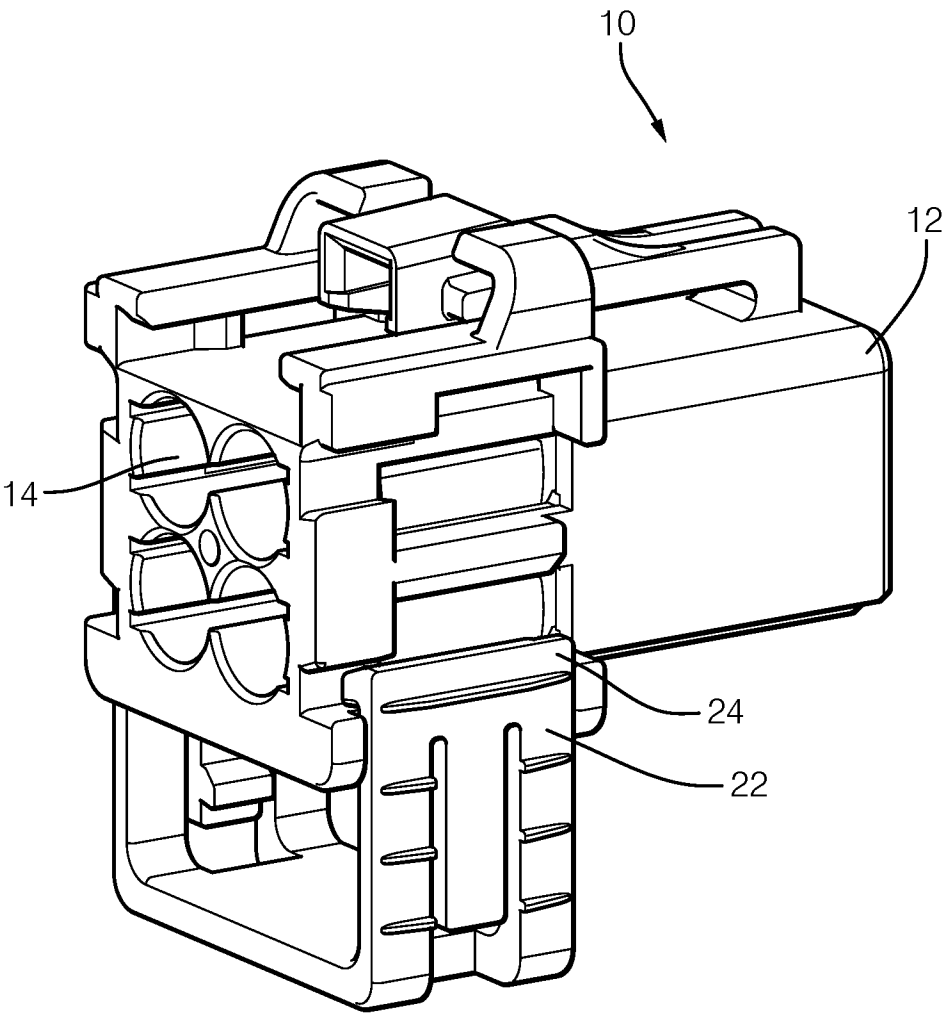
FIG. 1A is a perspective view of a connector with a terminal retainer device in a pre-staged position, according to one embodiment of the invention.

FIGS. 1A and 1B illustrate the connector 10 with the retainer 22 in the pre-staged position 24. In the pre-staged position 24, the first latch features 36 of the outer arms 30 are engaged with the lower grooves 16 and the post 44 is not inserted into the cavities 14. In the pre-staged position 24, terminals may be inserted through the rear openings of the cavities 14 until they contact the forward stops 46 extending into the front openings of the cavities 14.

Figure 2B:
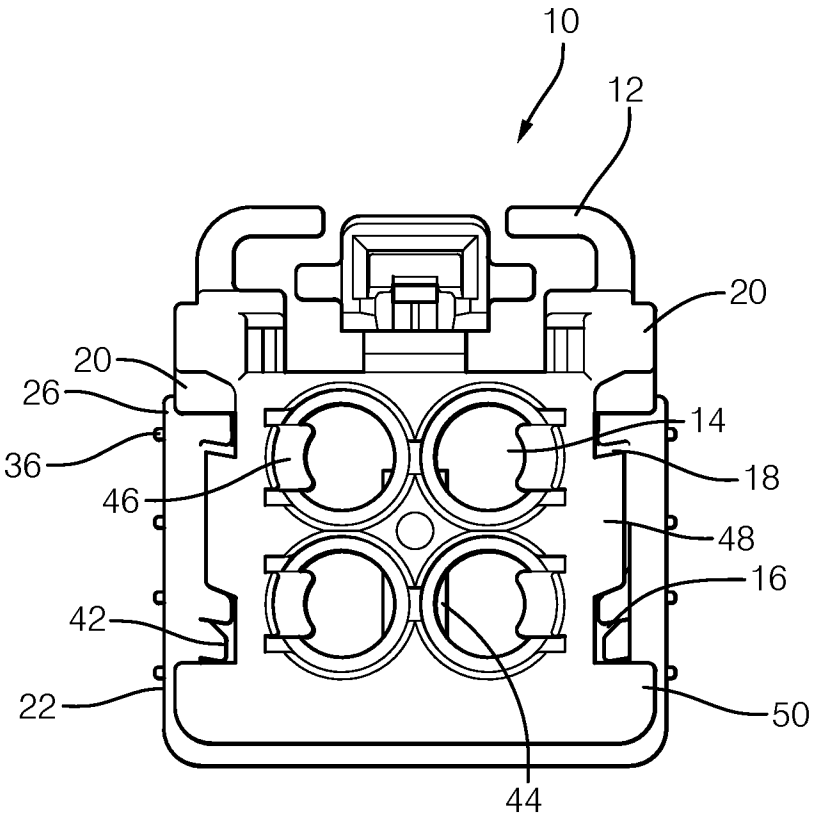
FIG. 2B is an end view of the connector of FIG. 1A with the terminal retainer device in the staged position, according to one embodiment of the invention.
Figure 2A:
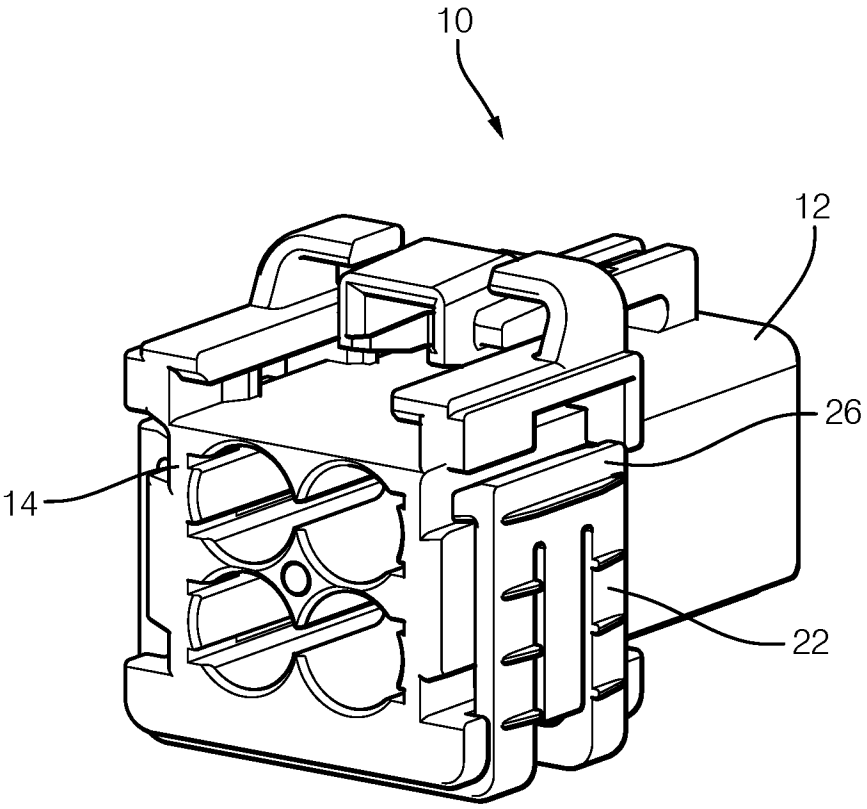
FIG. 2A is a perspective view of the connector of FIG. 1A with the terminal retainer device in a staged position, according to one embodiment of the invention.
Figure 3:
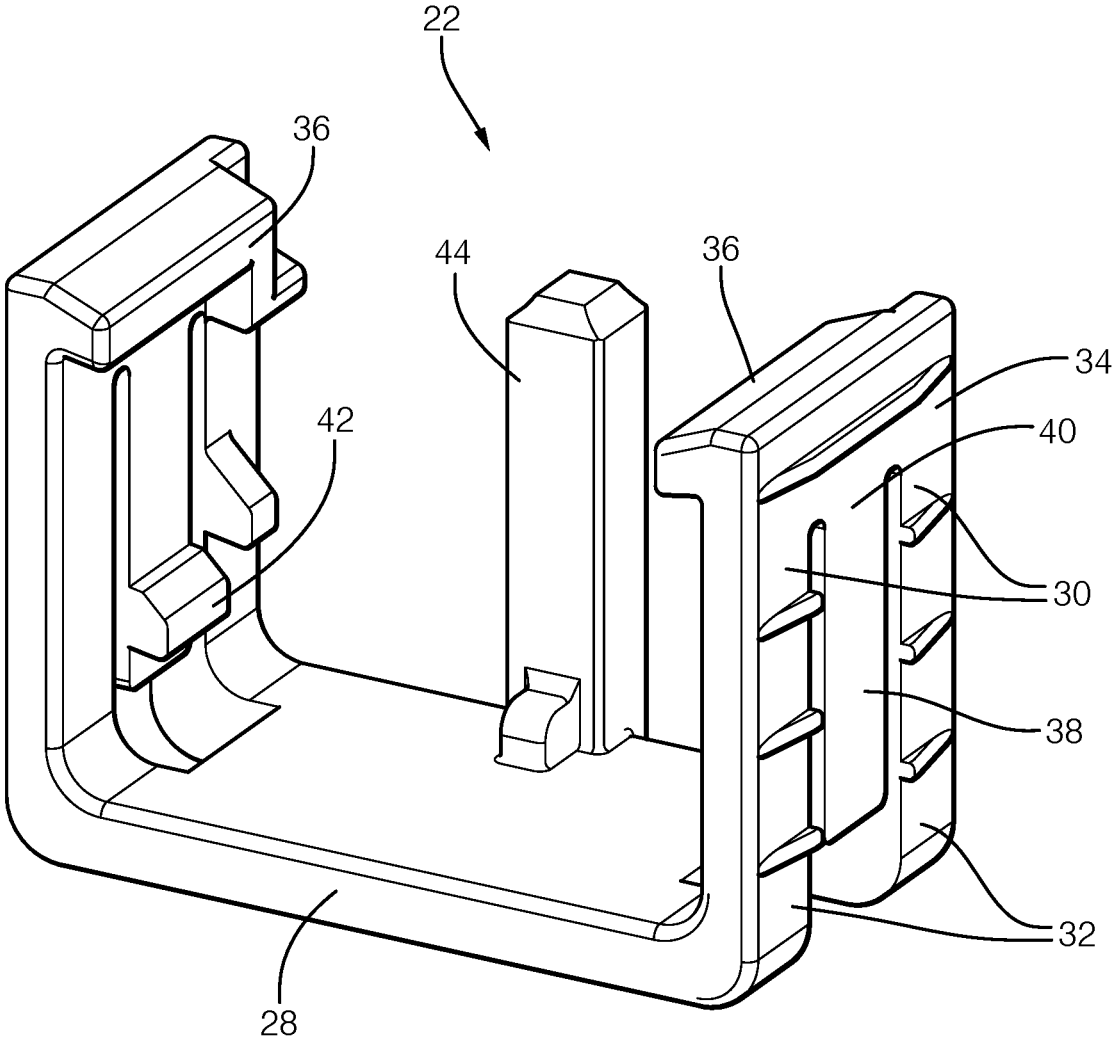
FIG. 3 is a perspective view of the terminal retainer device of FIG. 1A, according to one embodiment of the invention.

FIGS. 2A and 2B illustrate the connector 10 with the retainer 22 in the staged position 26. In the staged position 26, the first latch features 36 of the outer arms 30 are engaged with the upper grooves 18, the second latch features 42 of the inner arms 38 are engaged with the lower grooves 16 and the post 44 is partially blocking the rear openings of the cavities 14. In the staged position 26, removal of the terminals from the cavities 14 is inhibited by the forward stops 46 extending into the front openings of the cavities 14 and the post 44 extending into the rear openings of the cavities 14. As the retainer 22 is moved from the pre-staged position 24 to the stage position, the outer arms 30 flex outwardly to leave the lower groove 16 and then snap inwardly once the clear of the ridge 48 between the lower and upper grooves 16, 18 to engage the upper groove. The inner arms 38 also flex outwardly as they contact the lower surface of the connector body 12 and then snap inwardly once they clear the ridge 50 between the lower surface and the lower groove 16 to engage the lower groove 16.

Figure 4:
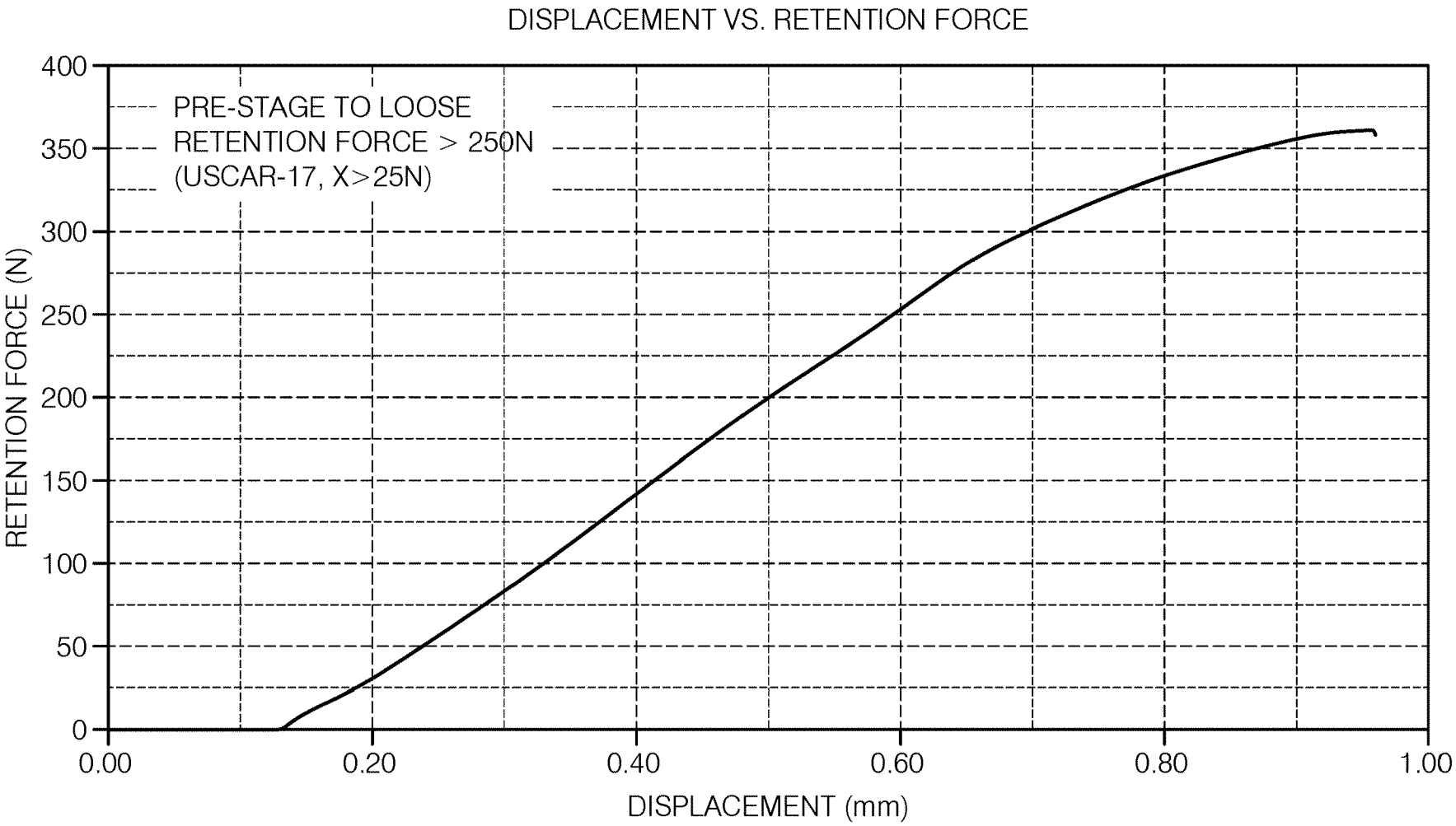
FIG. 4 is a force-displacement graph illustrating a force required to remove the terminal retainer device of the connector of FIG. 1A from the pre-staged position, according to one embodiment of the invention.

FIG. 4 shows a force-displacement graph generated by a finite element analysis illustrating that a force greater than 250 Newtons (N) is required to disengage the first latch features 36 of the retainer 22 from the lower grooves 16 of the connector body 12 when the retainer 22 is in the pre-staged position 24 by pulling the base 28 of the retainer 22 when the first latch features 36 and the lower surface of the lower grooves 16 have a back angle of 10 degrees.

Figure 5:
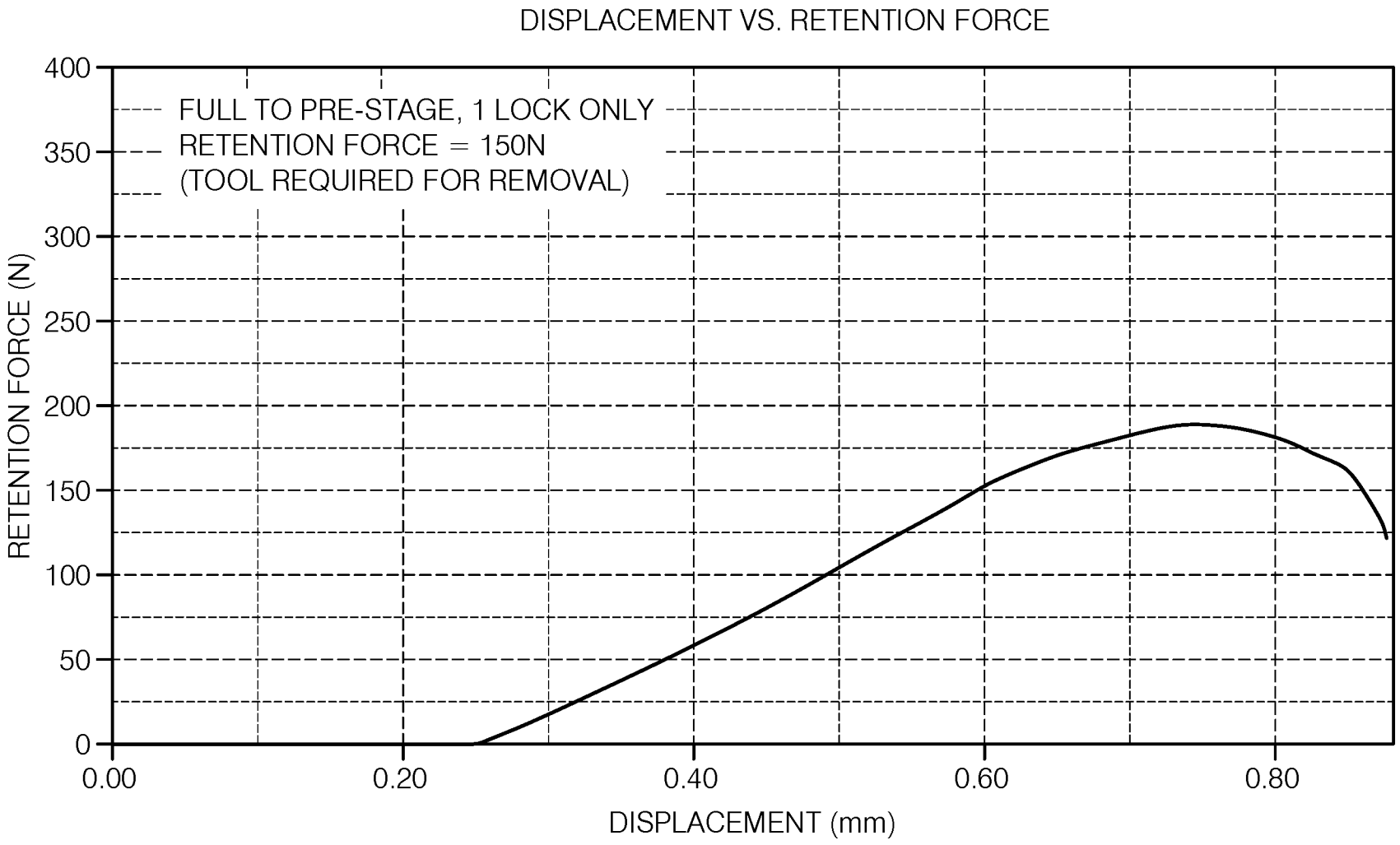
FIG. 5 is a force-displacement graph illustrating a force required to move the terminal retainer device of the connector of FIG. 1A from the staged position to the pre-staged position when only one set of latch features are engaged, according to one embodiment of the invention.

FIG. 5 shows a force-displacement graph generated by a finite element analysis illustrating that a force greater than 150 N is required to move the retainer 22 from the staged position 26 to the pre-staged position 24 by pulling the base 28 of the retainer 22 when the first latch features 36 and the lower surface of the upper grooves 18 have a back angle of 10 degrees and the second latch features 42 are not engaged with the lower grooves 16.

Figure 6:
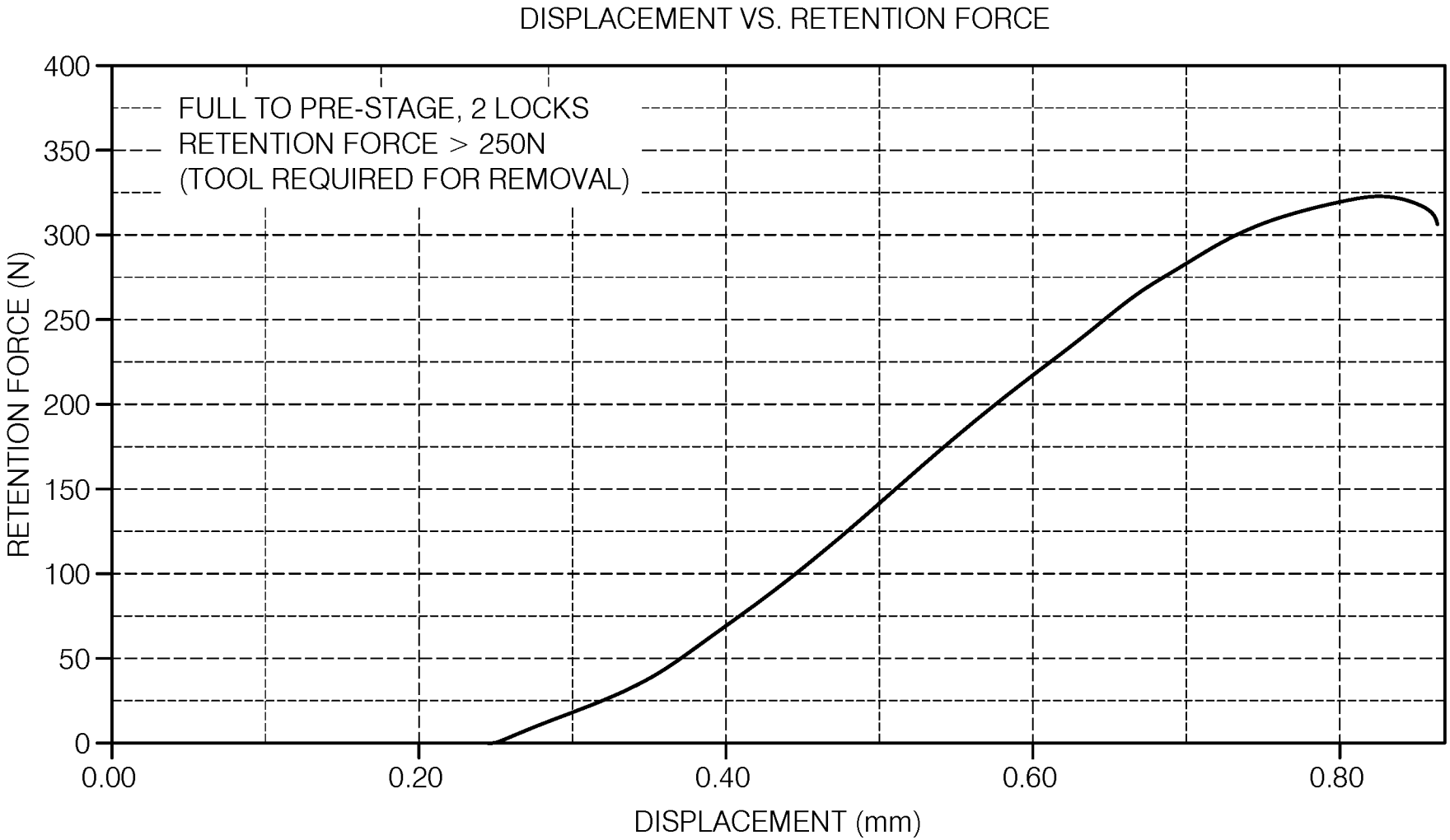
FIG. 6 is a force-displacement graph illustrating a force required to move the terminal retainer device of the connector of FIG. 1A from the staged position to the pre-staged position when two sets of latch features are engaged, according to one embodiment of the invention.

FIG. 6 shows a force-displacement graph generated by a finite element analysis illustrating that a force greater than 250 N is required to move the retainer 22 from the staged position 26 to the pre-staged position 24 by pulling the base 28 of the retainer 22 when the first latch features 36 and the lower surface of the upper grooves 18 have a back angle of 10 degrees, the second latch features 42 and the lower surface of the lower grooves 16 also have a back angle of 10 degrees and the second latch features 42 are engaged with the lower grooves 16.

Accordingly, a connector system 10 is provided. The inner arm 38 provides the benefit increasing retention force holding the retainer 22 to the connector body 12 in the staged position 26. The use of common features, i.e., the lower grooves 16, to hold the retainer 22 in the pre-staged and staged positions. Further, the post 44 provides a robust locking surface for multiple row connection systems and provide assurance that terminals are properly seated within the cavities 14.

While the illustrated embodiment is directed to an electrical connector assembly, other embodiments may be envisioned that are adapted for use with other types of connector assemblies for fiber optic cables, pneumatic tubes, hydraulic tubes, or a hybrid connector assembly including two or more of the items listed above.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A connector system, comprising:

a connector body defining a terminal cavity extending therethrough and a first groove and a second groove each extending along an outer surface of the connector body;

a terminal retainer attached to the connector body and moveable from a pre-staged position to a staged position, said terminal retainer configured to retain a terminal within the terminal cavity when in the staged position, said terminal retainer having:

a base, a pair of first cantilevered arms attached to and extending from the base, a crossbar extending between free ends of the pair of first cantilevered arms defining a first latch feature, and a second cantilevered arm attached to and extending from the crossbar, said second cantilevered arm disposed intermediate the pair of first cantilevered arms and defining a second latch feature, wherein the first latch feature engages the first groove when the terminal retainer is in the pre-staged position and wherein the first latch feature engages the second groove and the second latch feature engages the first groove when the terminal retainer is in the staged position.

2. The connector system according to claim 1, wherein the terminal retainer further comprises a terminal retaining post extending from the base and configured to partially block an opening in the terminal cavity when the terminal retainer is in the staged position, thereby inhibiting removal of the terminal from the terminal cavity.

3. The connector system according to claim 2, wherein the terminal retaining post extends perpendicularly from the base.

4. The connector system according to claim 1, wherein the pair of first cantilevered arms extend from a distal edge of the base.

5. The connector system according to claim 1, wherein the pair of first cantilevered arms extend perpendicularly from the base.

6. The connector system according to claim 1, wherein the second cantilevered arm extends perpendicularly from the base.

7. An electrical connector system, comprising:

a connector body defining a plurality of terminal cavities extending therethrough and first grooves and second grooves extending along two opposed outer surfaces of the connector body;

a terminal retainer attached to the connector body and moveable from a pre-staged position to a staged position, said terminal retainer configured to retain terminals within the plurality of terminal cavities when in the staged position, said terminal retainer having:

a base, pairs of first cantilevered arms attached to and extending from two opposed distal edges of the base, crossbars extending between free ends of the pair of first cantilevered arms defining first latch features, and second cantilevered arms attached to and extending from the crossbars, said second cantilevered arms disposed intermediate each pair of first cantilevered arms and defining a second latch feature, wherein the first latch features engage the first grooves when the terminal retainer is in the pre-staged position and wherein the first latch features engage the second grooves and the second latch features engage the first grooves when the terminal retainer is in the staged position.

8. The electrical connector system according to claim 7, wherein the terminal retainer further comprises a terminal retaining post extending from the base and configured to partially block openings of the plurality of terminal cavities when the terminal retainer is in the staged position, thereby inhibiting removal of the terminals from the plurality of terminal cavities.

9. The electrical connector system according to claim 8, wherein the terminal retaining post extends perpendicularly from the base.

10. The electrical connector system according to claim 7, wherein the pair of first cantilevered arms extend from a distal edge of the base.

11. The electrical connector system according to claim 7, wherein the pair of first cantilevered arms extend perpendicularly from the base.

12. The electrical connector system according to claim 7, wherein the second cantilevered arm extends perpendicularly from the base.

* * * * *